US011148464B1

(12) United States Patent
Chen

(10) Patent No.: US 11,148,464 B1
(45) Date of Patent: Oct. 19, 2021

(54) PATTERNED STRUCTURE

(71) Applicant: Hsin-Nien Chen, Taichung (TW)

(72) Inventor: Hsin-Nien Chen, Taichung (TW)

( * ) Notice: Subject to any disclaimer, the term of this patent is extended or adjusted under 35 U.S.C. 154(b) by 0 days.

(21) Appl. No.: 16/898,810

(22) Filed: Jun. 11, 2020

(51) Int. Cl.
*B44F 1/02* (2006.01)
*B25B 23/16* (2006.01)
*B25G 1/10* (2006.01)

(52) U.S. Cl.
CPC ..... *B44F 1/02* (2013.01); *B25B 23/16* (2013.01); *B25G 1/102* (2013.01); *Y10T 428/12201* (2015.01)

(58) Field of Classification Search
CPC . B44F 1/02; B25B 23/16; B25G 1/102; Y10T 428/12201
USPC ..... 428/573
See application file for complete search history.

(56) References Cited

U.S. PATENT DOCUMENTS 2,572,275 A * 10/1951 Millmather, Jr. ..... B44C 1/222 451/57
7,225,708 B2 * 6/2007 Chen ..... B25B 13/463 192/43.2
8,690,907 B1 * 4/2014 Janardhan ..... A61B 17/12122 606/200
2011/0244194 A1 * 10/2011 Hogue ..... B32B 5/12 428/187
2015/0083547 A1 * 3/2015 Wolters ..... B65G 23/08 193/37

FOREIGN PATENT DOCUMENTS

CN 104278268 A * 1/2015 ..... B22F 1/00
JP 2014205394 A * 10/2014 ..... B60C 13/00

* cited by examiner

*Primary Examiner* — Humera N. Sheikh
*Assistant Examiner* — John D Schneible
(74) *Attorney, Agent, or Firm* — Muncy, Geissler, Olds & Lowe, P.C.

(57) ABSTRACT

A patterned structure is provided, including a plurality of pattern groups. Each the pattern group has a plurality of patterned band regions. Each the patterned band region extends from a staring end to an ending end. Each the patterned band region has a plurality of pattern units. The pattern unit of one of the patterned band region partial overlaps the pattern unit of another patterned band region.

10 Claims, 8 Drawing Sheets

PATTERNED STRUCTURE

BACKGROUND OF THE INVENTION

Field of the Invention

The present invention relates to a patterned structure.

Description of the Prior Art

Most products are designed to have core structure and processed according mainly to specific use of the products. Therefore, little attention is paid to the auxiliary structure (such as patterned structure) of other parts of the object. As a result, most products are each produced to only have a smooth outer surface or to be labeled with a label.

However, as technological advancement and processing technology are progressing, all manufacturers have sufficient processing machines and skills to produce various products. Nowadays, customers are more concerned about not only the product's function but also the texture and aesthetic appearance of the object or tool.

The present invention is, therefore, arisen to obviate or at least mitigate the above-mentioned disadvantages.

SUMMARY OF THE INVENTION

The main object of the present invention is to provide a patterned structure which has uniqueness, is highly recognizable and is practical in use.

To achieve the above and other objects, the invention provides a patterned structure configured to be disposed on an outer circumferential face of an object, the object defining an axial direction and a circumferential direction, the patterned structure including: a plurality of pattern groups, circumferentially arranged on the outer circumferential face, each of the plurality of pattern groups including a plurality of patterned band regions and defining a first end and a second end, each of the plurality of patterned band regions extending from the first end toward the second end, each of the plurality of patterned band regions including a plurality of pattern units, any of the plurality of pattern units of a first one of the plurality of patterned band regions being, in the circumferential direction and in the axial direction, offset from and partially overlapped with at least one of the plurality of pattern units of a second one of the plurality of patterned band regions.

To achieve the above and other objects, the invention provides a patterned structure configured to be disposed on an outer circumferential face of an object, the patterned structure including: a plurality of pattern groups, circumferentially arranged on the outer circumferential face, each of the plurality of pattern groups including a plurality of patterned band regions and defining a first end and a second end, each of the plurality of patterned band regions spirally extending from the first end toward the second end, each of the plurality of patterned band regions including a plurality of pattern units, each of the plurality of pattern units of any of the plurality of patterned band regions being overlapped with one another.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
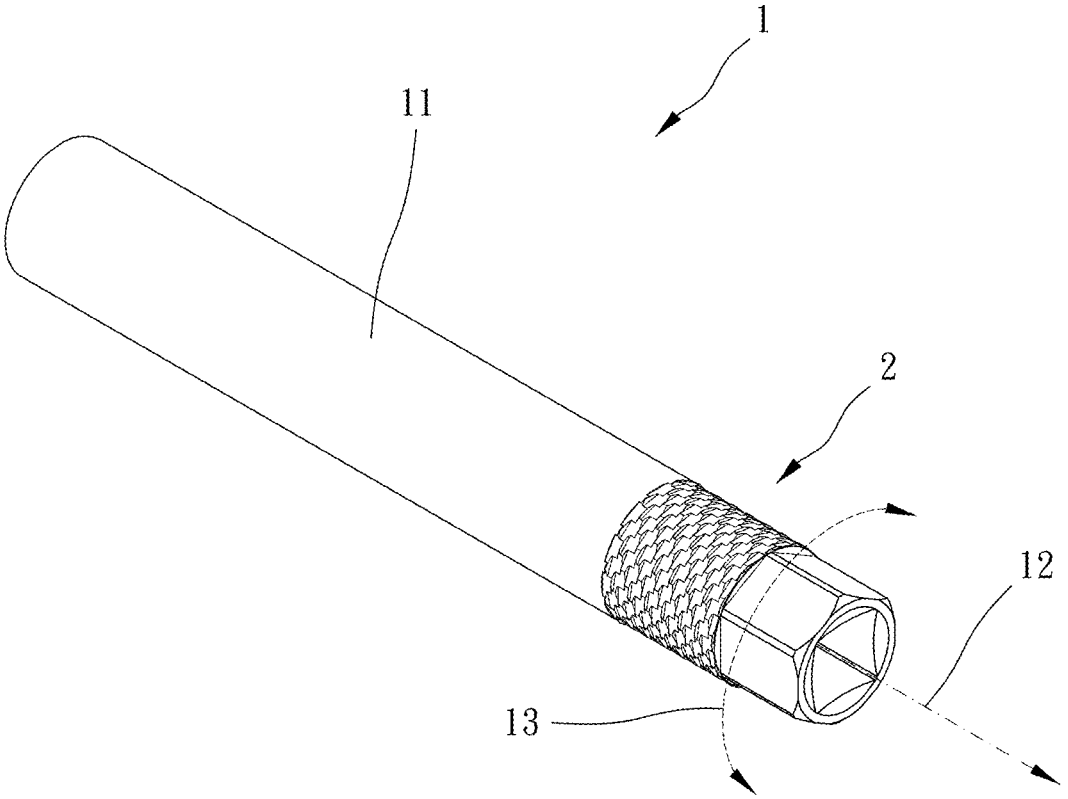
FIGS. 1 and 2 are stereograms of a first preferable embodiment of the present invention.
Figure 2:
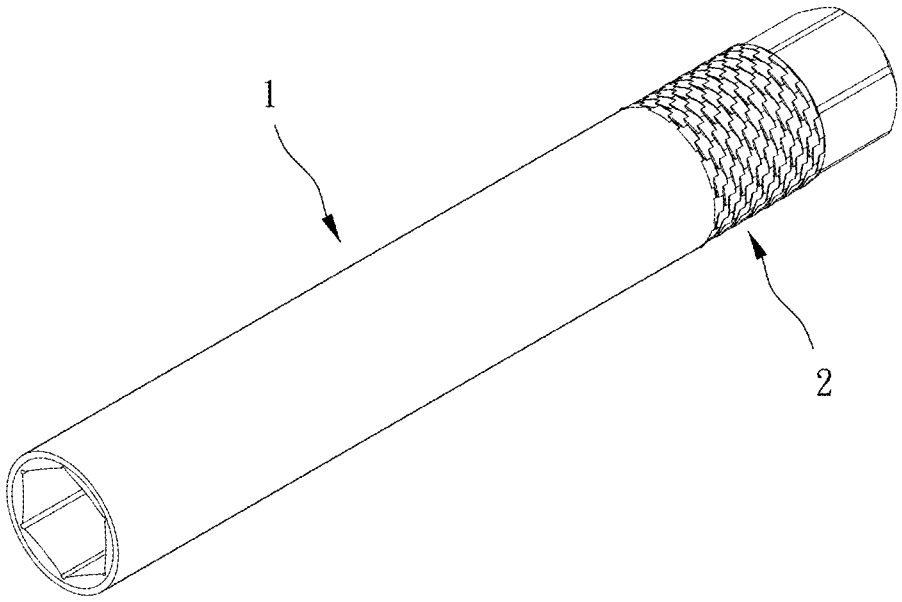
Figure 3:
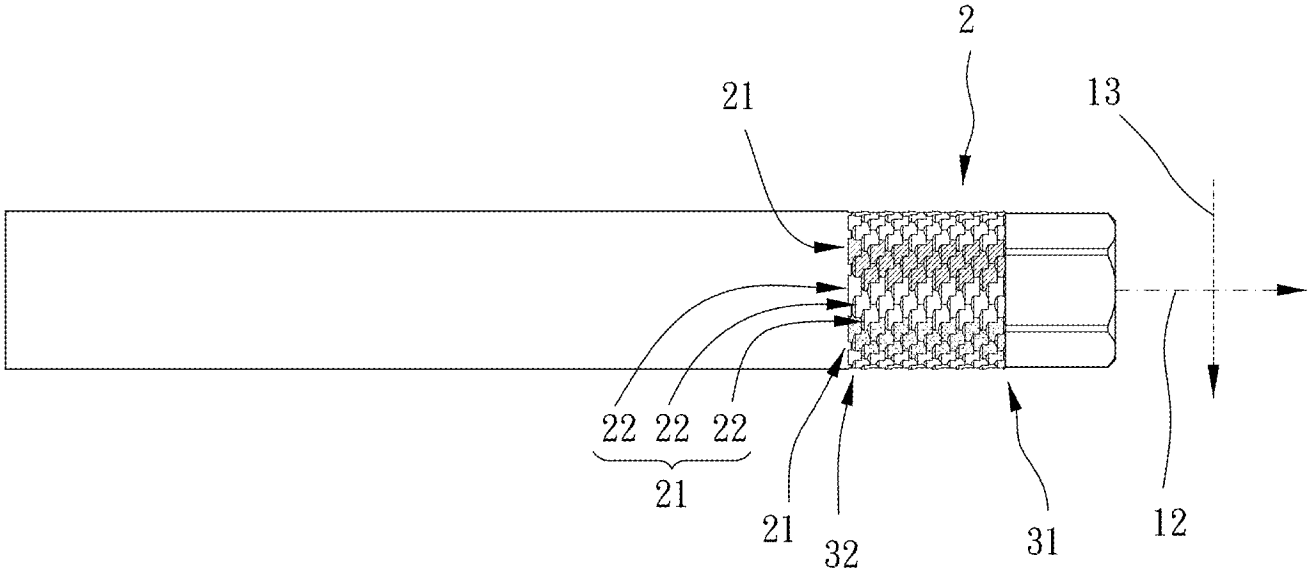
FIG. 3 is a side view of FIG. 1.

Please refer to FIGS. 1 to 6 for a preferable embodiment of the present invention. A patterned structure 1 of the present invention is configured to be disposed on an outer circumferential face 11 of an object 1 such as an extension rod, socket, shank of a wrench, container or the like. The object 1 defines an axial direction 12 and a circumferential direction 13. The patterned structure 2 includes a plurality of pattern groups 21.

Specifically, the plurality of pattern groups 21 are circumferentially arranged on the outer circumferential face 11, each of the plurality of pattern groups 21 includes a plurality of patterned band regions 22 and defines a first end 31 and a second end 32, and each of the plurality of patterned band regions 22 extends from the first end 31 toward the second end 32. Each of the plurality of patterned band regions 22 includes a plurality of pattern units 23, any of the plurality of pattern units 23 of a first one of the plurality of patterned band regions 22 is, in the circumferential direction 13 and in the axial direction 12, offset from and partially overlapped with at least one of the plurality of pattern units 23 of a second one of the plurality of patterned band regions 22.

The patterned structure 2 having the plurality of the pattern units 23 is highly recognizable for recognition of a manufacturer or various products. Additionally, the plurality of the pattern units 23 provide large contact or grip area, thus being good for gripping and controlling.

Preferably, the object 1 is made of metal, and the patterned structure 2 is circumferentially formed on the outer circumferential face 11 by cutting. As a result, the plurality of the pattern units 23 cooperate with luster and high reflectivity of the metallic object 1 so as to be capable of presenting abundant visual appearance under different view angles and/or light sources.

Figure 4:
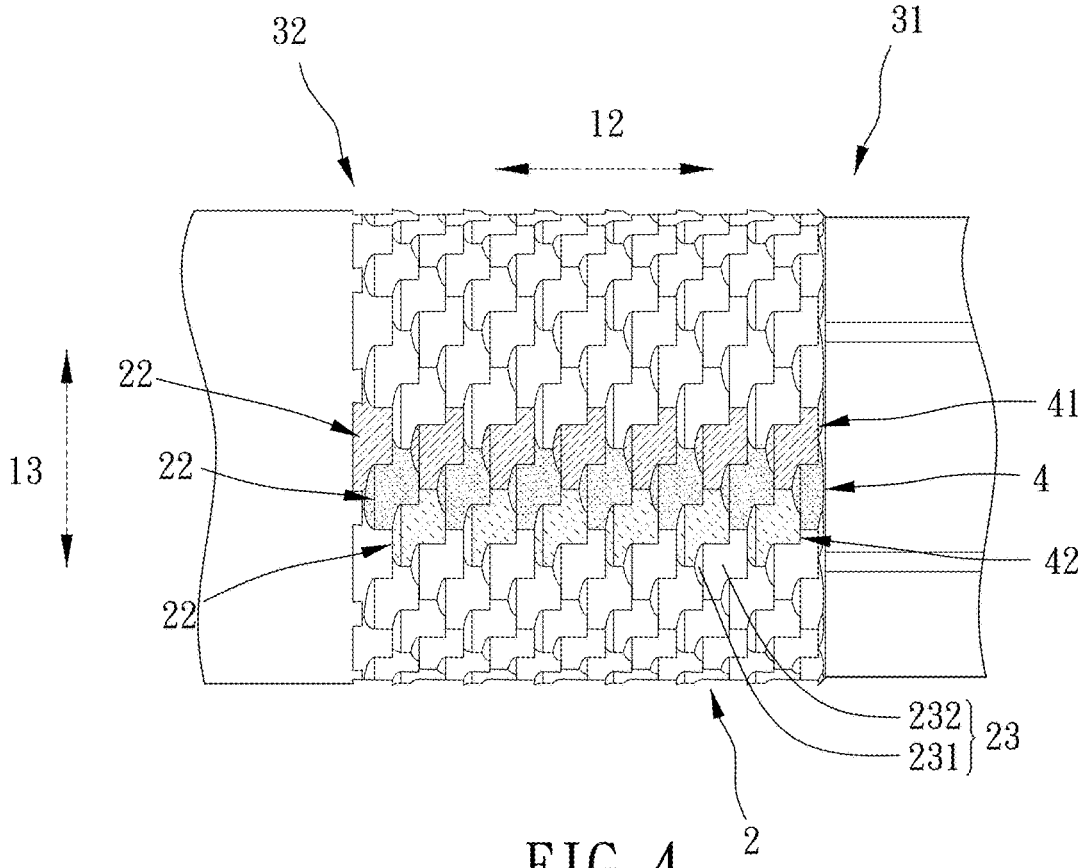
FIG. 4 is a drawing showing pattern groups including patterned band regions having pattern units according to the first preferable embodiment of the present invention.

For clear explanation, in FIG. 4, partial pattern units 23 of the patterned structure 2 are colored. Each of the plurality of patterned band regions 22 extends in a straight line. In the axial direction 12, the plurality of pattern units 23 of any said the patterned band region 22 are arranged in interval, and the pattern units 23 of a first one of the plurality of patterned band regions 22 and the pattern units 23 of a second one of the plurality of patterned band regions 22 are arranged alternatively.

Figure 5:
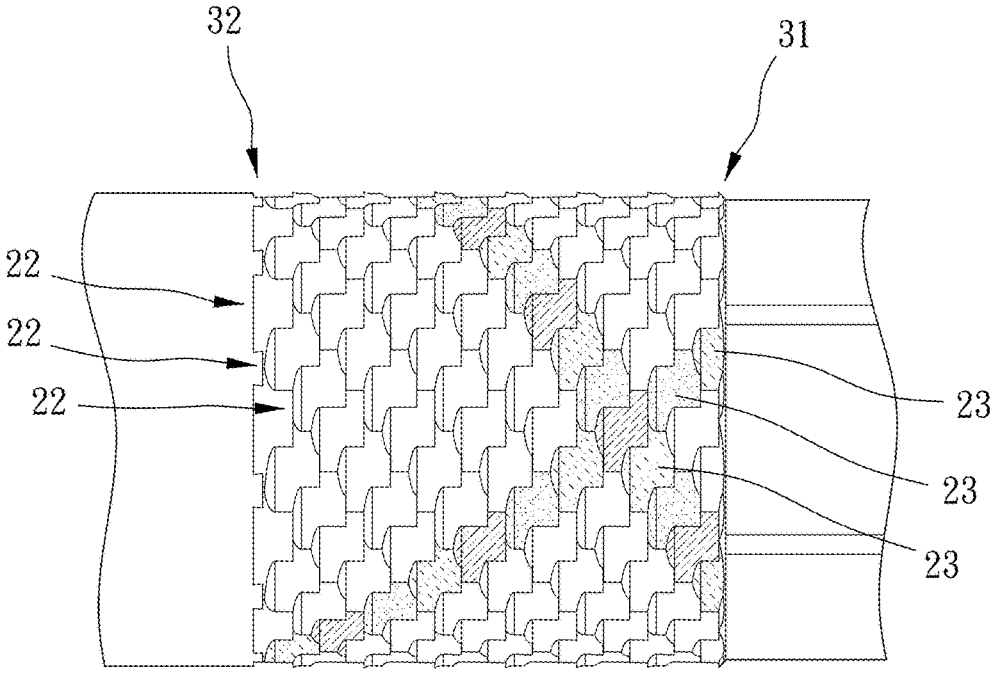
FIG. 5 is a drawing showing pattern units spirally extending and partially overlapped with one another.

Specifically, a first one of the plurality of patterned band regions 22 is defined as a base region 4, in the circumferential direction 13, and two opposite sides by the base region 4 are defined as a first side 41 and a second side 42. One of the pattern units 23 of a second one of the plurality of patterned band regions 22 located at the first side 41, one of the pattern units 23 of the base region 4 and one of the pattern units 23 of a third one of the plurality of patterned band regions 22 located at the second side 42 are arranged spirally and each partially overlapped with one another. For example, the pattern unit 23 at the first side 41 is located at the upper left of the pattern unit 23 of the base region 4, and the pattern unit 23 of the base region 4 is located at the upper left of the pattern unit 23 of the second side 42, so that the pattern units 23 of the plurality of patterned band regions 22 are spirally arranged relative to the circumferential direction 13, as shown in FIG. 4 or FIG. 5.

Each said pattern unit 23 includes a peak portion 231 and a valley portion 232 connected with each other, and the peak portions 231 and the valley portions 232 of the pattern units 23 of each of the plurality of pattern groups 21 are arranged alternatively. An area of the valley portion 232 is equal to or greater than an area of the peak portion 231, thus providing large contact area. In any said pattern unit 23, the peak portion 231 is located between the valley portion 232 and the first end 31, and the peak portion 231 is tapered toward the second end 32, thus indicating operation end of the object 1 clearly by observing the pattern units 23.

Figure 6:
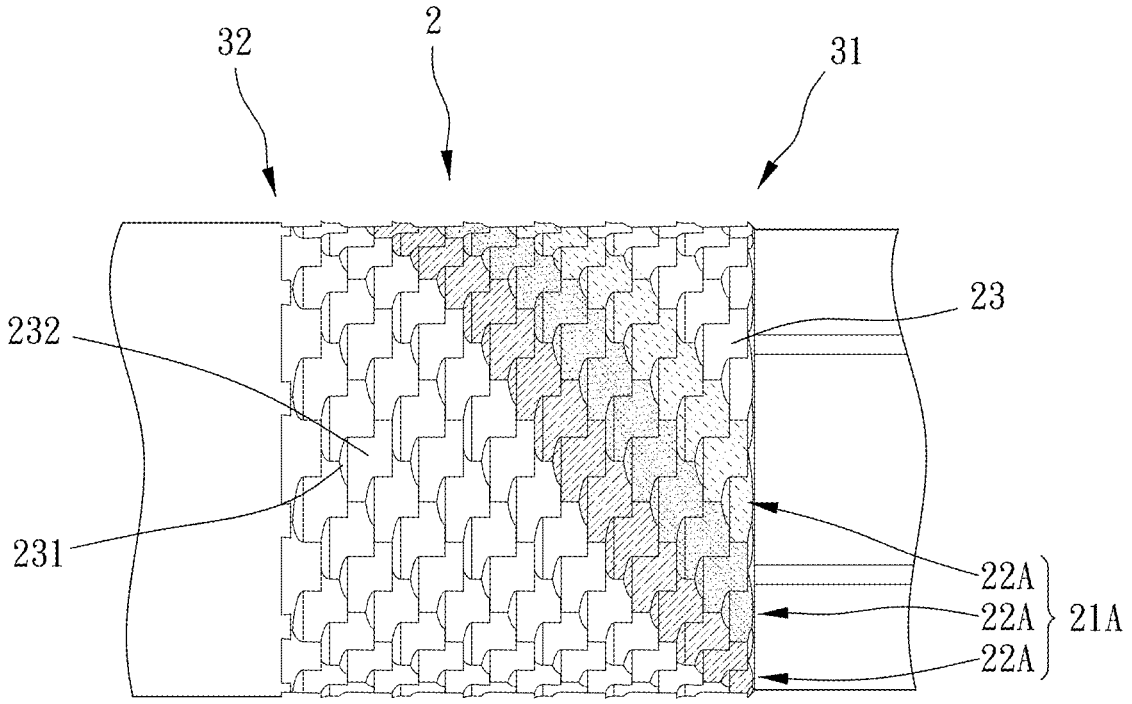
FIG. 6 is a drawing showing another type of patterned band region.

In an alternative embodiment shown in FIG. 6, the patterned band regions 22A extend spirally from the first end 31 toward the second end 32 to form another type of pattern groups 21A. Each of the plurality of patterned band regions 22A includes a plurality of pattern units 23, and each of the pattern units 23 of any said patterned band region 22A are partially overlapped with one another. Specifically, a first one of the plurality of patterned band regions 22A is partially overlapped with any of two second ones of the plurality of patterned band regions 22A which are neighbor to the first one of the plurality of patterned band regions 22A. Each said pattern unit 23 includes a peak portion 231 and a valley portion 232 connected with each other, the peak portions 231 and the valley portion 232 of the pattern units 23 of each of the plurality of pattern groups are arranged alternatively, and each said peak portion 231 of a first one of the plurality of patterned band regions 22A is partially overlapped with one said valley portion 232 of a second one of the plurality of patterned band regions 22A.

Figure 7:
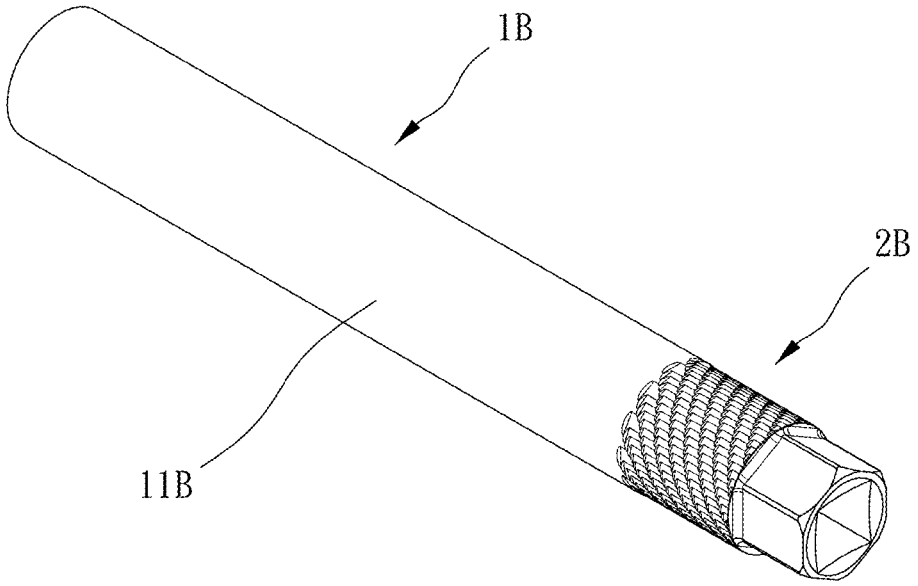
FIG. 7 is a stereogram of a second preferable embodiment of the present invention.
Figure 8:
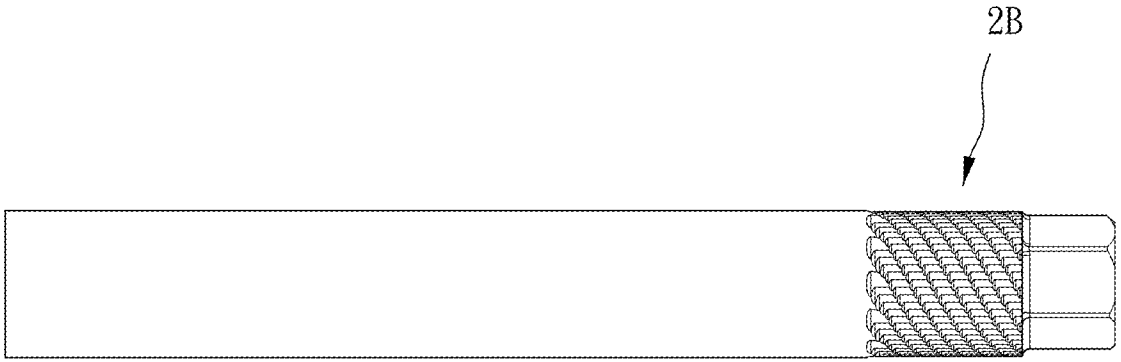
FIG. 8 is a side view of FIG. 7.
Figure 9:
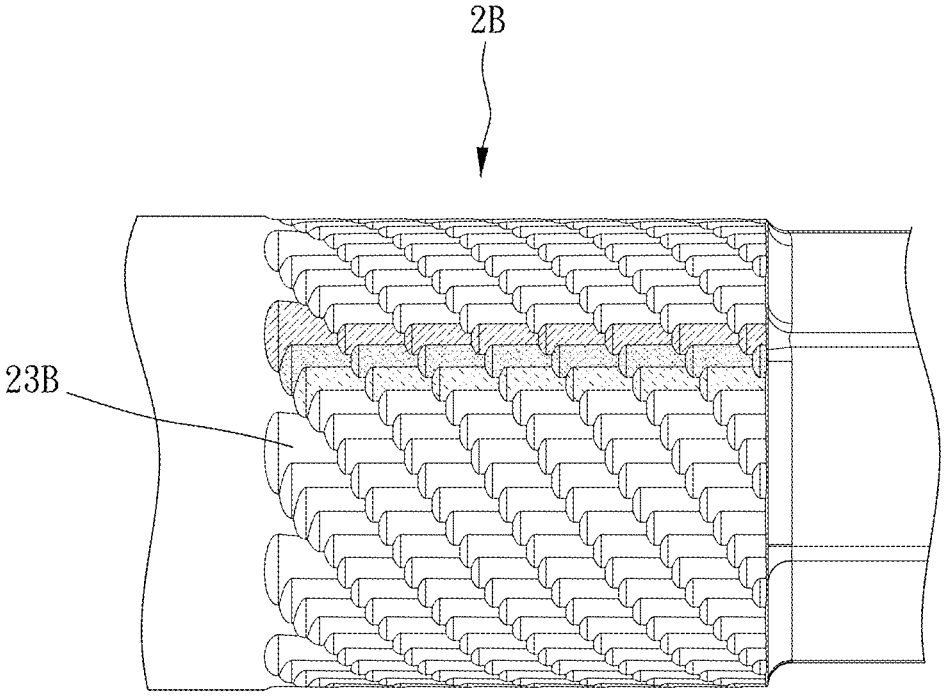
FIG. 9 is a drawing showing pattern groups including patterned band regions having pattern units according to the second preferable embodiment of the present invention.

It is noted that another patterned structure 2B having another type of pattern unit 23B may be formed on an outer circumferential face 11B of an object 1B (as shown in FIGS. 7-9), and this can be made by using different cutting tool(s).

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A patterned structure, configured to be disposed on an outer circumferential face of an object, the object defining an axial direction and a circumferential direction, the patterned structure including:

a plurality of pattern groups, circumferentially arranged on the outer circumferential face, each of the plurality of pattern groups including a plurality of patterned band regions and defining a first end and a second end, each of the plurality of patterned band regions extending from the first end toward the second end, each of the plurality of patterned band regions including a plurality of pattern units, any of the plurality of pattern units of a first one of the plurality of patterned band regions being, in the circumferential direction and in the axial direction, offset from and partially overlapped with at least one of the plurality of pattern units of a second one of the plurality of patterned band regions.

2. The patterned structure of claim 1, wherein each of the plurality of patterned band regions extends in a straight line.

3. The patterned structure of claim 2, wherein a first one of the plurality of patterned band regions is defined as a base region, in the circumferential direction, two opposite sides by the base region are defined as a first side and a second side, and one of the pattern units of a second one of the plurality of patterned band regions located at the first side, one of the pattern units of the base region and one of the pattern units of a third one of the plurality of patterned band regions located at the second side are arranged spirally and each partially overlapped with one another.

4. The patterned structure of claim 2, wherein each said pattern unit includes a peak portion and a valley portion connected with each other, and the peak portions and the valley portions of the pattern units of each of the plurality of pattern groups are arranged alternatively.

5. The patterned structure of claim 4, wherein an area of the valley portion is equal to or greater than an area of the peak portion.

6. The patterned structure of claim 5, wherein the peak portion is tapered toward the second end.

7. The patterned structure of claim 3, wherein each said pattern unit includes a peak portion and a valley portion connected with each other, the peak portions and the valley portion of the pattern units of each of the plurality of pattern groups are arranged alternatively; an area of the valley portion is equal to or greater than an area of the peak portion; the object is made of metal; the patterned structure is circumferentially formed on the outer circumferential face by cutting; in any said pattern unit, the peak portion is located between the valley portion and the first end; the peak portion is tapered toward the second end; in the axial direction, the plurality of pattern units of any said the patterned band region are arranged in interval, and the pattern units of a first one of the plurality of patterned band regions and the pattern units of a second one of the plurality of patterned band regions are arranged alternatively.

8. A patterned structure, configured to be disposed on an outer circumferential face of an object, the patterned structure including:

a plurality of pattern groups, circumferentially arranged on the outer circumferential face, each of the plurality of pattern groups including a plurality of patterned band regions and defining a first end and a second end, each of the plurality of patterned band regions spirally extending from the first end toward the second end, each of the plurality of patterned band regions including a plurality of pattern units, each of the plurality of pattern units of any of the plurality of patterned band regions being overlapped with one another.

9. The patterned structure of claim 8, wherein a first one of the plurality of patterned band regions is partially overlapped with any of two second ones of the plurality of patterned band regions which are neighbor to the first one of the plurality of patterned band regions.

10. The patterned structure of claim 9, wherein each said pattern unit includes a peak portion and a valley portion connected with each other, the peak portions and the valley portion of the pattern units of each of the plurality of pattern groups are arranged alternatively, and each said peak portion of a first one of the plurality of patterned band regions is partially overlapped with one said valley portion of a second one of the plurality of patterned band regions.

* * * * *